US008278812B2

(12) United States Patent
Eisen et al.

(10) Patent No.: US 8,278,812 B2
(45) Date of Patent: Oct. 2, 2012

(54) GRID FOR VACUUM ELECTRON DEVICE AND METHOD FOR MANUFACTURE OF SAME

(75) Inventors: Edward Lawrence Eisen, Sunnyvale, CA (US); James Eric Kline, Menlo Park, CA (US)

(73) Assignee: Communications and Power Industries, Inc., Palo Alto, CA (US)

( * ) Notice: Subject to any disclaimer, the term of this patent is extended or adjusted under 35 U.S.C. 154(b) by 307 days.

(21) Appl. No.: 12/008,069

(22) Filed: Jan. 7, 2008

(65) Prior Publication Data

US 2010/0090601 A1 Apr. 15, 2010

(51) Int. Cl.
*H01J 1/20* (2006.01)

(52) U.S. Cl. ..... 313/347; 315/5.37

(58) Field of Classification Search ..... 313/265, 313/293, 347–349; 315/5.37
See application file for complete search history.

(56) References Cited

U.S. PATENT DOCUMENTS

| | | | | |
|---|---|---|---|---|
| 2,886,733 | A * | 5/1959 | Naill | 313/265 |
| 4,737,680 | A * | 4/1988 | True et al. | 313/349 |
| 4,975,617 | A | 12/1990 | Van Gorkum | |
| 5,990,622 | A * | 11/1999 | Schult et al. | 315/5.37 |
| 6,635,978 | B1 * | 10/2003 | Clerc | 313/293 |
| 2002/0021076 | A1 * | 2/2002 | Carr et al. | 313/414 |

FOREIGN PATENT DOCUMENTS

| | | | |
|---|---|---|---|
| EP | 0884752 | A | 12/1998 |
| GB | 2333892 | A | 8/1999 |
| JP | 05182595 | A | 7/1993 |
| JP | 05182595 | A * | 7/1993 |

OTHER PUBLICATIONS

Clayworth, G. et al. "The IOT-a new, Environmentally-Friendly Tube for UHF Television Transmitters," Broadcasting Convention, 1992, IBC., International Amsterdam, Netherlands, London, UK, IEE, UK, Jan. 1, 1992, pp. 45-50.

PCT International Search Report from PCT/US2009/030363, Jun. 4, 2009.

* cited by examiner

*Primary Examiner* — Nimeshkumar Patel
*Assistant Examiner* — Mary Bowman
(74) *Attorney, Agent, or Firm* — Nixon Peabody LLP

(57) ABSTRACT

A grid component for use with a vacuum electron device (VED), such as an inductive output tube (IOT), includes a skirt that adds structural support and aids in alignment. The grid component has a dome in which a grid pattern is formed and includes an annular, concentric flange surrounding the dome. The skirt is formed concentrically around the flange. Alignment orifices may be provided in the flange for passage of alignment pins in the assembled product. The grid, flange, and skirt are a unitary component and are formed by a chemical vapor deposition (CVD) or similar process, in which a mandrel is used to provide a deposition surface. The mandrel is placed in a furnace, and a high-temperature CVD process is used to break down a hydrocarbon gas to thereby deposit a pyrolytic graphite coating onto the mandrel. The mandrel may include a skirt template to provide the characteristic skirt.

18 Claims, 4 Drawing Sheets

GRID FOR VACUUM ELECTRON DEVICE AND METHOD FOR MANUFACTURE OF SAME

CROSS-REFERENCE TO RELATED APPLICATIONS (Not applicable)

BACKGROUND

1. Field of the Invention

The present invention relates to grids for linear beam RF (radio frequency) vacuum tube devices having an electron emitting cathode and an RF-modulated grid closely spaced thereform.

2. Description of the Related Art

It is well known in the art to utilize a vacuum electron (VED) device, such as a klystron or traveling wave tube amplifier, to generate or amplify high frequency RF energy. Such devices generally include an electron-emitting cathode and an anode spaced therefrom. In the case of IOTs (Inductive Output Tubes) and similar devices, a grid is also included, positioned in an inter-electrode region between the cathode and the anode. Grid-to-cathode spacing is critical and is directly related to the performance and longevity of the linear beam device. The material of the grid is typically pyrolytic graphite (PG), selected for its excellent thermal properties.

The grid is typically formed by a hydrocarbon gas deposition process over a mandrel into a blank cylinder or "cup," designated 10, in FIG. 1*a*. The closed top end 12 of the cup 10 is shaped to include a dome 14. Cup 10 is then cut, along the dashed line L, with the intention of forming a flange 16 (FIG. 1*b*) that should be concentric with the dome 14, for purposes of proper alignment during assembly and operation of the vacuum electron device (VED). Dome 14 is then laser cut (FIG. 1*c*) to provide the characteristic grid features. A side elevational view of the finished grid is provided in FIG. 1*d*.

Deposition of the PG to form the cup 10 involves a high-temperature CVD (chemical vapor deposition) process that breaks down the hydrocarbon gas, thereby depositing a pyrolytic graphite coating onto the precision CNC-machined mandrel (not shown). The deposited PG coating is allowed to grow in thickness so that it becomes self-sufficient and subsequently releases from the mandrel as the film and mandrel are cooled from high temperatures. Since the hydrocarbon gas deposits carbonaceous growths on all surfaces exposed to the gas flow in the working area of the CVD furnace hot zone, the contiguity of the film can be stressed at discontinuities or sharp bends. These discontinuities then become stress concentrators. As the film cools down, the desired portion of the film can interact with these stress concentrators and thereby develop significant internal residual thermal stresses, regardless of consideration of mandrel material. These film stresses result from the severe anisotropy of the in-plane and out-of-plane thermal expansion coefficients and the restriction that the graphitic layers fully remain contiguous across an imaginary vector normal to the film growth surface. This contiguity restriction results from the inability of the carbon atoms to diffuse and realign in any meaningful timescale at the deposition temperature (nominally about 1700-2200° C.) and below. When the differences in coefficients of thermal expansion between the film and the underlying mandrel are taken into effect, the residual thermal stresses are amplified. As a result, discontinuities often act as crack initiation sites. The cracks can propagate a sufficient distance in the material to destroy the desired product, reducing cup yield to as low as 30% during manufacture of the cup 10, before the laser cutting stage of FIG. 1*c* is even reached. Even when the residual thermal stresses are not immediately manifested, they render the product particularly fragile and subject to warping, or "potato-chipping," at handling, assembly, and during normal operation.

BRIEF SUMMARY

As described herein, a method for manufacturing a grid component for a vacuum electron device (VED) includes forming a cup blank by a deposition process, the cup blank being generally cylindrical in shape and having a dome portion and a side portion that includes a skirt portion defined by a circumferential discontinuity on a deposition surface, separating the cup blank from the deposition surface, removing a portion of the side portion of the cup blank but retaining at least a portion of the skirt portion, and removing portions of the dome portion to form a grid pattern.

Further as described herein, a grid component for use in a vacuum electron device (VED) includes a dome having a grid pattern formed thereon, an annular flange surrounding the dome, and a skirt surrounding the annular flange and extending in the direction of the dome.

Further as described herein, a vacuum electron device (VED) includes an anode, an electron gun including a cathode configured to generate a beam of electrons that are directed towards the anode, a collector configured to receive electrons from the of electrons, and a grid configured to modulate electrons from the beam of electrons, the grid. The grid includes a dome having a grid pattern formed thereon, an annular flange surrounding the dome, and a skirt surrounding the annular flange and extending in the direction of the dome.

DETAILED DESCRIPTION

The description herein is provided in the context of a grid for a vacuum electron device (VED) and a method for manufacturing of same. Those of ordinary skill in the art will realize that the following detailed description is illustrative only and is not intended to be in any way limiting. Other embodiments will readily suggest themselves to such skilled persons having the benefit of this disclosure. Reference will now be made in detail to implementations as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
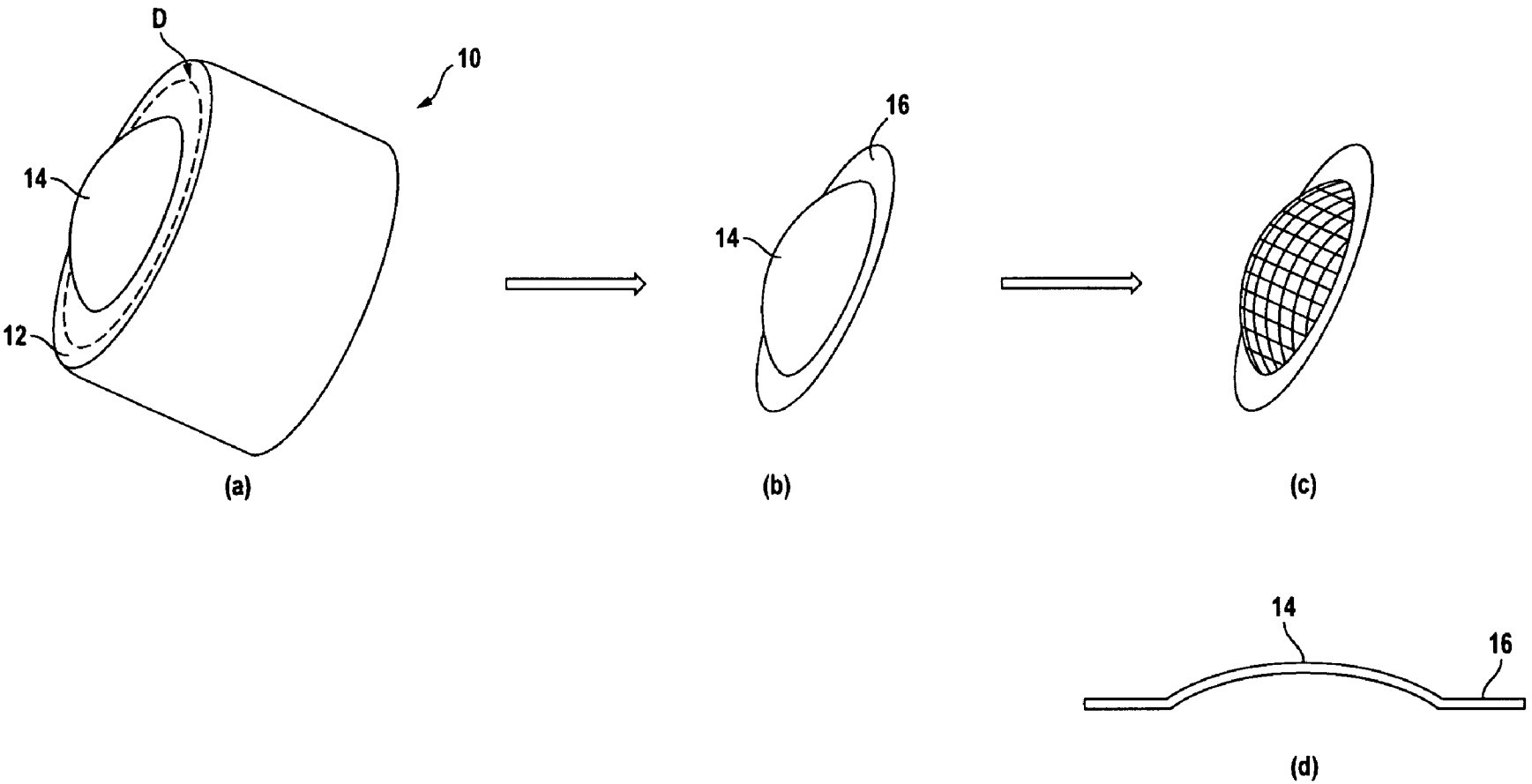
FIG. 1 (Prior Art)
FIG. 1 shows a prior art grid fabrication process.
Figure 2:
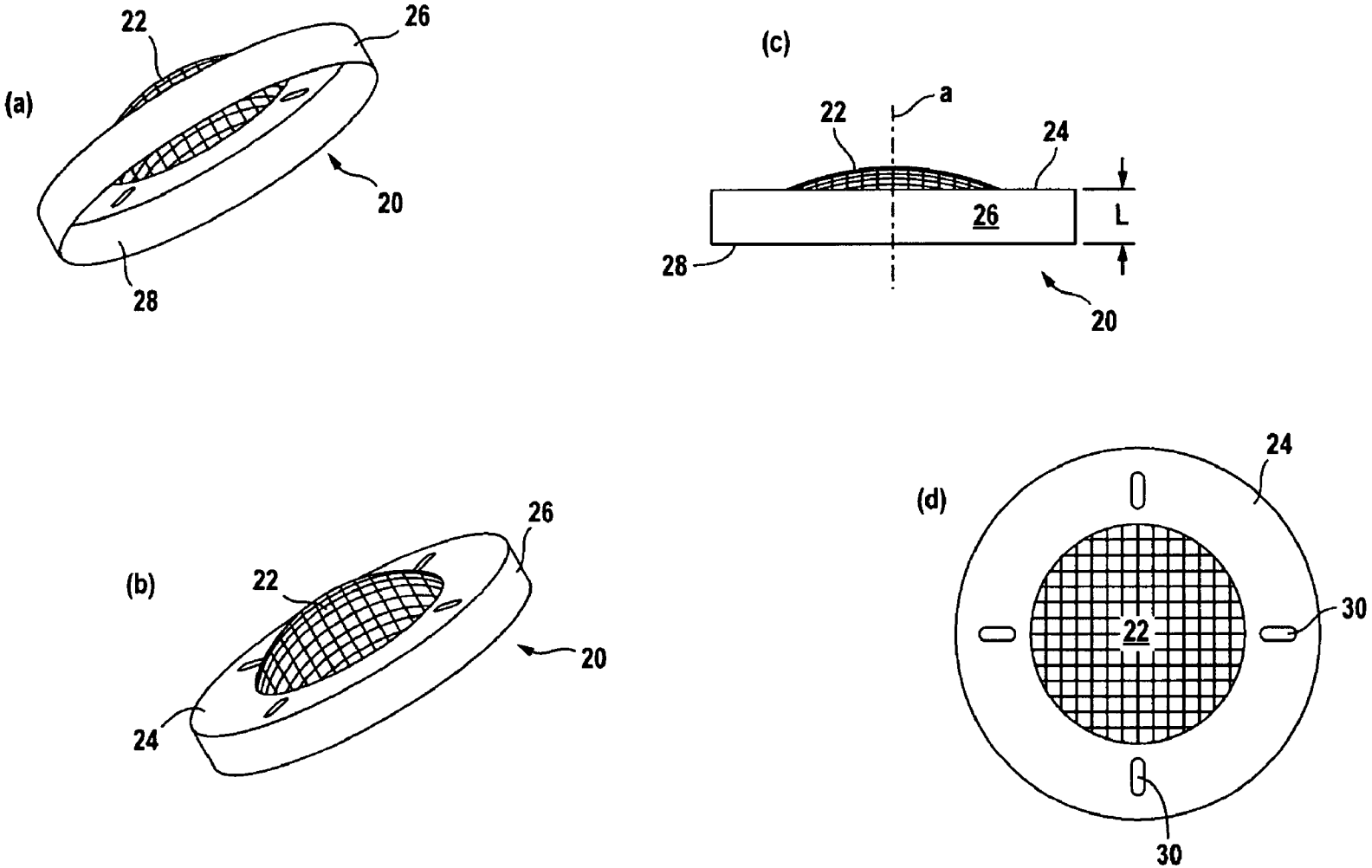
FIG. 2 is a shows various views of a convex grid component 20 arrangement.

FIG. 2 shows various views of a grid component 20, in which sketches (a) and (b) are isometric views of the grid, sketch (c) is a side elevational view, and sketch (d) is a top plan view. Grid component 20 is generally circular in shape. It includes a central dome 22 having a plurality of cutout portions or holes (not labeled) to provide the characteristic grid pattern. Dome 22, which may be referred to as the grid, is the operative portion of the grid component 20 and is where RF modulation of the electron beam passing from the cathode to the anode takes place during operation. Dome 22 is concentric about a central axis a, and is surrounded by and concentric with an annular flange 24. Dome 22 is thus disposed interiorly of annular flange 24. A skirt 26 is provided transversely to and at one end of the flange 24, exteriorly of the flange, and also concentrically about central axis a. Grid component 20 is open at end 28 opposite to the dome 22 and flange 24.

Skirt 26 provides reinforcement to the grid, and its depiction in FIG. 2 exaggerates its length for purposes of illustration. This reinforcement is particularly desirable as the size of the grid component 20 increases in accommodation of devices of increased power and with larger-diameter electron beams. In practice, the length L of the skirt is on the order of about 50 to about 100 thousandths of an inch for a 30,000 to 100,000 watt device. The skirt 26 also plays an important role in maintaining concentricity between the dome 22 and the flange 24 during fabrication of the grid component 20, and concentricity of the actual grid or dome 22 relative to the other components in the assembled device. Concentricity may also be aided by alignment pins 30 passing through the flange 30 by way of suitable orifices. In sketch (d) these are shown as taking the form of slots 32 formed in the flange 24.

Figure 3:
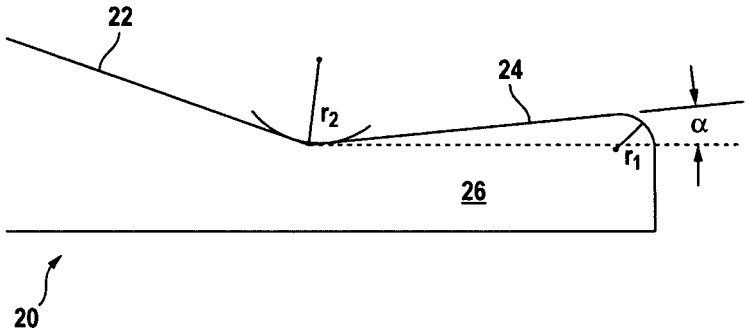
FIG. 3 a partial side elevational view of a variation of grid component 20.

FIG. 3 relates to a variation on the shape of the grid component 20, in which case the flange 24 is not perpendicular to the axis a, but inclines in the direction of skirt 26, at a predetermined angle $\alpha$ that may be up to about 5 degrees. Also shown in FIG. 3 are curvatures $r_1$ and $r_2$ at the respective transitions between flange 24 and skirt 26, and between flange 24 and dome 22. While these curvatures are inherent at some level between different surfaces of an integral component grown and deposited in the manner of grid 20, as further detailed below, they can be enhanced, or increased, if necessary, for example to provide stress relief at the molecular level. The nature of this stress relief, while complex, is well-understood and does not warrant further discussion.

Figure 4:
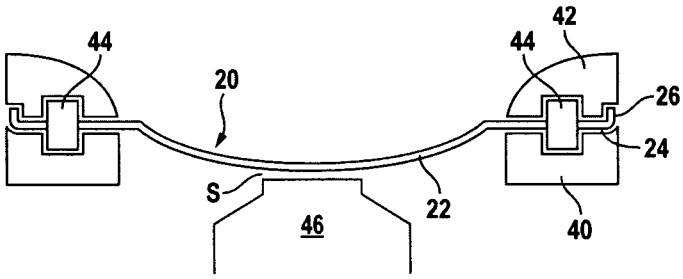
FIG. 4 is a schematic view of grid component 20 assembled in a VED.
Figure 7:
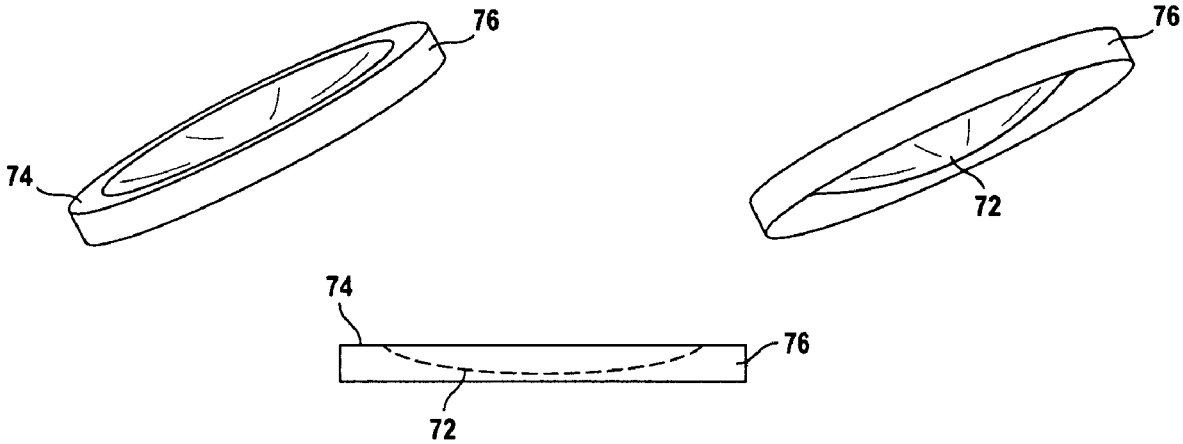
FIG. 7 shows various views of an alternative concave grid component arrangement.

FIG. 4 is a view of grid component 20 in an assembled state within a vacuum electron device (VED) such as an inductive output tube (IOT). Grid component 20 is clamped in position between blocks 40 and 42, which may be annular in shape and be composed respectively of copper and (bulk, machined) graphite. Alignment pins 44 are provided to maintain concentricity of the grid component 20 within the assembly, and particularly with respect to cathode 46 from whence the electron beam emanates for passage through the grid or dome 22. A critical separation distance s between cathode 46 and dome 22 is maintained, even during extreme heating of the device during operation and despite expansion of the various components at differing rates. The assembled grid component 20 as depicted in FIGS. 2-4 is such that the dome 22 can be defined as being convex relative to flange 24, with skirt 26 extending from flange 24 in the opposite direction of the dome. It will be appreciated that this is not a necessary limitation. Instead, skirt 26 can extend from flange 24 in the same direction as dome 22, and in a concave arrangement. This is depicted in FIG. 7, in which the dome, flange and skirt are designated 72, 74 and 76, respectively.

Figure 5A:
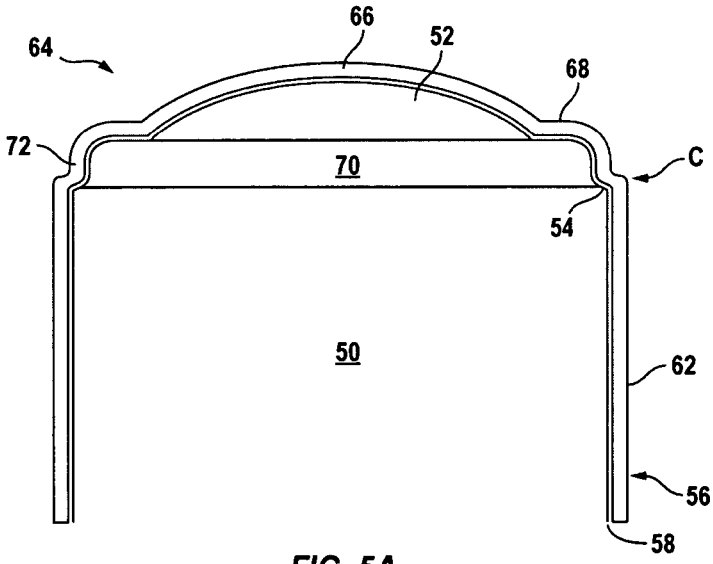
FIGS. 5*a* and 5*b* are a schematic depictions relating to a grid component fabrication process.

A process by which the grid component 20 is fabricated is described with reference to FIGS. 5*a* and 5*b*. With reference first to FIG. 5*a*, a generally cylindrical mandrel 50 having a mandrel dome 52 on one surface thereof and having a circumferential discontinuity in the form of a shoulder 54 provided on the side of the mandrel is used. Shoulder 54 serves to define a skirt template 70. The mandrel 50 provides a deposition surface and is placed in a furnace, and a high-temperature CVD (chemical vapor deposition) process is used to break down a hydrocarbon gas to thereby deposit a pyrolytic graphite coating onto the mandrel. The result is a grid blank or cup 56 which is generally cylindrical in shape, in the form of the mandrel 50 and skirt template 70. Grid blank 56 has an open end 58, a side portion 62, and a closed face 64 including a dome portion 66 surrounded by concentric annular flange portion 68 and a skirt portion 72 in the periphery thereof. The grid blank or cup 56 is then separated from the mandrel 50 and cut along side 62 at the location of shoulder 54. The location of the cut is generally indicated by the arrow c. The dome portion 66 is then processed to precision cut holes therein in the form of the characteristic grid pattern.

In an alterative embodiment, described with reference to FIG. 5*b*, the mandrel (50') can be provided with a lip 54' in lieu of shoulder 54 of FIG. 5*a*. Lip 54' defines a skirt template 70' around which skirt portion 72' of grid blank 56' is formed during deposition. The deposition process also forms dome portion 66' and shoulder portion 68' in the manner described above. In the arrangement of FIG. 5*b*, it may be necessary to cut grid blank 56' at arrow c' before removal of the grid blank 56' from the mandrel 50' can be effected because of the negative interference that the lip 54' presents.

Since, during fabrication of the mandrel 50, the mandrel exterior and the skirt template 70 are machined in the same CNC operation, there is an inherent increase in concentricity between the dome portion 66, the flange portion 68 and the skirt portion 72 of the blank 54, and of the corresponding dome 22, flange 24 and skirt 26 of the resultant grid component 20. This increased concentricity simplifies assembly of the grid to the electron gun (not shown) of the VED device, by eliminating multiple steps in the precision alignment sequence. Moreover, the skirt 26 itself adds considerable stiffness, thereby lessening the probability of handling damage. An advantageous feature of the precursor skirt portion 72 is that it adds considerable resistance to deformation and warping of the cup dome portion 66 and flange portion 68 during processing. Residual thermal stresses are characteristic of all pyrolytic graphite depositions, and in this thickness regime, the grid blank 54 is subject to significant warping. Although the grid blank is fabricated out of pyrolytic graphite, concerns for thin-wall metal machining and forming parts are paralleled in the net effect.

Figure 5B:
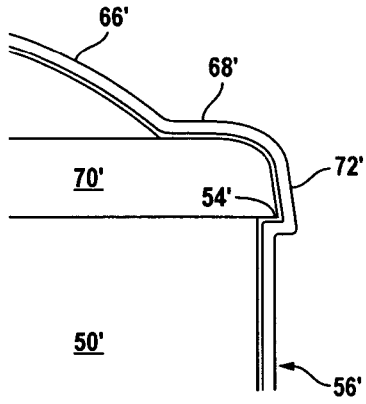

Mandrel 50, 50' in FIGS. 5*a* and 5*b* has a male arrangement, with dome 52 protruding from one surface thereof. It is alternatively possible to use a mandrel having a female configuration that includes a depression in lieu of the a dome.

Figure 8:
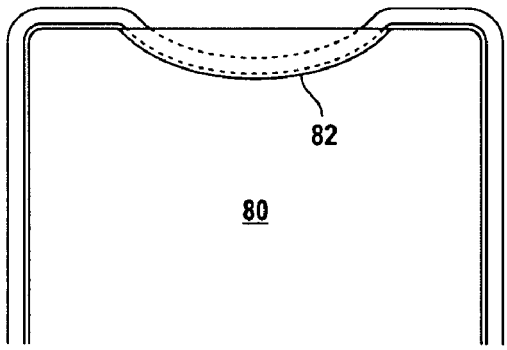
FIG. 8 shows an alternative female-type mandrel for the production of the concave grid component arrangement of FIG. 7.

Such a female mandrel configuration is show in FIG. 8. Mandrel 80 is shown to have a depression 82 formed on a surface thereof. Deposition of a pyrolytic graphite layer on mandrel 80 produces the concave arrangement of FIG. 7, with the skirt extending from the flange in the same direction as the dome, rather than in the opposite arrangement. The skirt template in a female mandrel, like that of the male mandrel, can have either a shoulder (FIG. 5*a*) or a lip (FIG. 5*b*). An inclination of the flange can also be built into the male mandrel 80, analogous to the arrangement of FIG. 3 supra.

All of the above methods produce a grid component (for example grid component 20 in FIG. 2) in which the various parts (grid 22, flange 24 and skirt 26) form a unitary component that is used in the assembled VED product.

Figure 6:
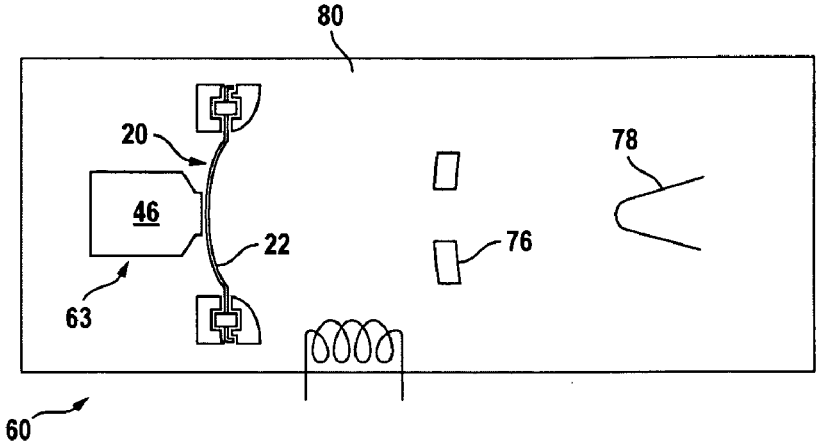
FIG. 6 is schematic view of a VED including grid component 20.

FIG. 6 is a schematic diagram of a inductive output tube (IOT) type VED in which the grid component 20 may be used. IOT 60 includes electron gun 63 having cathode 46 for emitting an electron beam (not shown). The electron beam passes through grid 22 for modulation thereby. An output signal is derived from output cavity 80. The beam passes towards anode 76 and the electrons therefrom are collected by an collector electrode 78, which can be a single stage or a multi-stage type collector, for example an multi-stage depressed collector (MSDC).

The above are exemplary modes of carrying out the invention and are not intended to be limiting. It will be apparent to those of ordinary skill in the art that modifications thereto can be made without departure from the spirit and scope of the invention as set forth in the following claims.

The invention claimed is:

1. A method for manufacturing a grid component for a vacuum electron device (VED), the method comprising:

forming a cup blank by a deposition process on a deposition surface that includes a skirt template, the cup blank being generally cylindrical in shape and having a dome portion bulging in a first direction and a side portion that includes a skirt portion and an annular flange formed by the skirt template, the skirt portion extending in an opposite direction to the first direction, the annular flange concentrically formed around the dome portion such that the annular flange is between the dome portion and the portion of the skirt portion, the skirt portion formed to surround the annular flange;

separating the cup blank from the deposition surface;

removing a portion of the side portion of the cup blank but retaining at least a portion of the skirt portion;

removing portions of the dome portion to form a grid pattern; and removing portions of the annular flange to form one or more alignment orifices.

2. The method of claim 1, wherein at least one of the alignment orifices is a slot.

3. The method of claim 1, wherein the cup blank is formed of pyrolytic graphite.

4. The method of claim 1, wherein the cup blank is formed using chemical vapor deposition.

5. The method of claim 1, wherein the deposition surface is a mandrel having a circumferential discontinuity in the form of a shoulder formed on a side thereof

6. The method of claim 1, wherein the deposition surface is a mandrel having a circumferential discontinuity in the form of a lip formed on a side thereof.

7. The method of claim 1, wherein deposition is conducted on a male mandrel.

8. The method of claim 1, wherein deposition is conducted on a female mandrel.

9. A grid component for use in a vacuum electron device (VED) having an anode and an electron-emissive cathode, the grid component being mountable in an electron beam path between the anode and cathode and comprising:

a dome bulging in a first direction and having a grid pattern formed thereon;

an annular flange surrounding the dome;

a skirt surrounding the annular flange and extending in a direction opposite the first direction, such that when the grid is mounted in the VED between the cathode and anode with the dome in confronting relationship to the cathode, the skirt extends from the flange towards the anode, the dome, the annular flange, and the skirt formed on a deposition surface that includes a skirt template; and one or more alignment orifices disposed in the annular flange.

10. The grid component of claim 9, wherein the dome, annular flange and skirt are a unitary pyrolytic graphite component.

11. The grid component of claim 9, wherein the skirt is about 0.010" to about 0.100" in length.

12. The grid component of claim 9, wherein the flange is inclined at an angle $\alpha$ up to about 5 degrees.

13. The grid component of claim 9, wherein at least one of the alignment orifices is a slot.

14. A vacuum electron device (VED) comprising:

an anode;

an electron gun including a cathode configured to generate a beam of electrons that are directed towards the anode;

a collector configured to receive electrons from the cathode; and a grid configured to modulate electrons from the beam of electrons, the grid including:

a dome bulging in a first direction and having a grid pattern formed thereon;

an annular flange surrounding the dome;

a skirt surrounding the annular flange and extending in a direction opposite the first direction, such that when the grid is mounted in the VED between the cathode and anode with the dome in confronting relationship to the cathode, the skirt extends from the flange towards the anode, the dome, the annular flange, and the skirt formed on a deposition surface that includes a skirt template; and one or more alignment orifices disposed in the annular flange.

15. The VED of claim 14, wherein the dome, annular flange and skirt are a unitary pyrolytic graphite component.

16. The VED of claim 14, wherein the skirt is about 0.010" to about 0.100" in length.

17. The VED of claim 14, wherein the flange is inclined at an angle $\alpha$ up to about 5 degrees.

18. The VED of claim 14, wherein at least one of the alignment orifices is a slot.

* * * * *